United States Patent [19]

Roberts

[11] Patent Number: 4,903,394

[45] Date of Patent: Feb. 27, 1990

[54] METHOD OF MAKING A WINDOW TREATMENT CROWN

[76] Inventor: Beverly R. Roberts, 395 Castleridge Dr. NE., Atlanta, Ga. 30342

[21] Appl. No.: 291,970

[22] Filed: Dec. 30, 1988

[51] Int. Cl.[4] ..... B23P 25/00

[52] U.S. Cl. ..... 29/458; 29/577.2

[58] Field of Search ..... 29/445, 527.1, 458, 29/577.2; 52/90, 171, 270, DIG. 10; 108/108; 211/134, 135, 153; 248/235, 236, 250; 160/39; 428/57

[56] References Cited

U.S. PATENT DOCUMENTS

| | | | |
|---|---|---|---|
| 2,530,567 | 11/1950 | Cline | 160/39 |
| 2,636,557 | 4/1953 | Williams | 160/39 |
| 4,246,981 | 1/1981 | Givens | 160/39 |
| 4,378,070 | 3/1983 | Matheis | 211/134 X |

*Primary Examiner*—Timothy V. Eley

*Attorney, Agent, or Firm*—David P. Kelley

[57] ABSTRACT

A method of making a cornice board assembly in which the assembly has a face board, a dust board, and a pair of side boards made of expanded plastic foam material. The boards are joined together by means of a water based cement, with their edges in alignment, and the assembly is mounted on support brackets by means of thumbtacks.

8 Claims, 1 Drawing Sheet

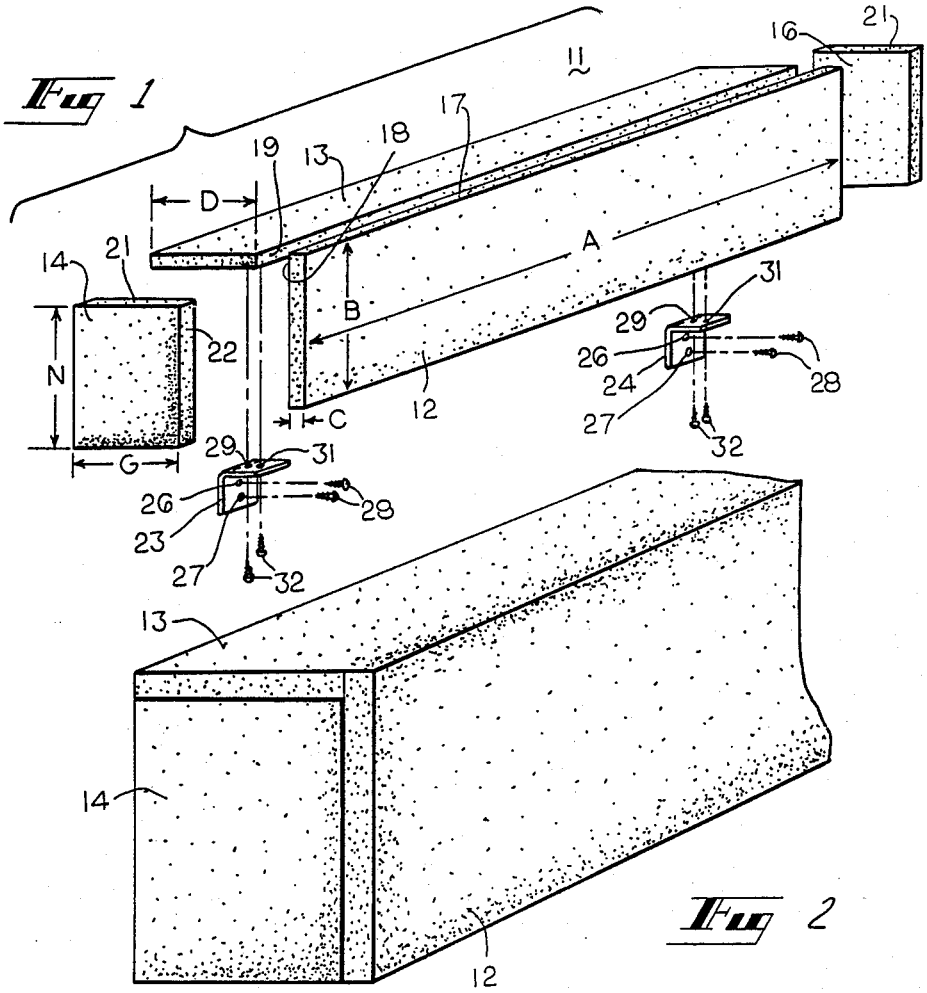
Fig 1
Fig 2
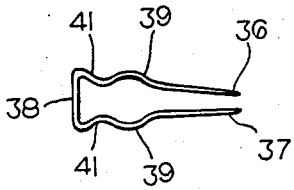
Fig 3A
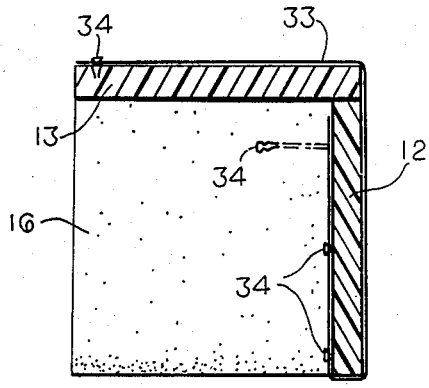
Fig 3

METHOD OF MAKING A WINDOW TREATMENT CROWN

FIELD OF THE INVENTION

This invention relates to decorative window treatments, and more particularly to crowns for use over windows, and to the method of making such crowns.

BACKGROUND OF THE INVENTION

A cornice board arrangement for use over, for example, a single width (36 inches) window generally comprises a face board, facing the room, a dust board extending from the top of the face board back to the wall above the window and first and second side boards at either end of the face and dust boards.

Heretofore, prior art cornice boards of the type described have generally been made of plywood or suitable wood, such as pine, that is inexpensive and easily worked. There are numerous problems involved in making cornices out of wood of any sort, however. In the first place, the wood must be sufficiently thick so that it will not bend, resulting in an unduly heavy and unwieldy cornice, and even with sufficient thickness, the wood still is subject to warping. In addition, because of the weight of the components involved, to ensure structural integrity, the assembler of the cornice must join the pieces together by screws, which are preferable, or by nails, thereby greatly increasing the weight of the cornice assembly while making assembly thereof tedious and time consuming. Other drawbacks to the use of wood are its permeability to moisture, its odor and its attraction to insects.

In the assembly of any wooden window treatment form, the various pieces thereof must be cut to proper size and shape by sawing, which adds to the difficulty of assembly, especially where the window is of a non-standard size, or where a shape other than straight edges is desired, and the individual pieces must be sawed to the proper length or shape. The assembly must then be mounted into position over the window, for example, which requires mounting brackets of sufficient strength to hold the heavy form which are mounted to the wall, for example, above the window. Because of the weight of the window treatment form, e.g., cornice assembly, such brackets must be mounted to the wall by toggle bolts or molly bolts, preferably the former, and screwed to the cornice assembly. Such a mounting arrangement is extremely difficult for one person to accomplish because of the weight and unwieldiness of the assembly. If, subsequently, it is necessary to remove the assembly, the reverse process is necessary, i.e., unscrewing all of the mounting screws joining the brackets to the cornice, and lifting the heavy form off of the brackets. Removal of the brackets themselves leaves large, unsightly holes in the wall.

It is customary to cover the exterior of the form with decorative fabric, which, because of the hardness of the wood surface, has to be stapled or tacked into place on the cornice. Thus, if at some future time it is necessary to remove the fabric for cleaning, for example, the tedious and potentially fabric damaging process of removing the staples is necessary, with no assurance that the fabric will remain undamaged so that it may be cleaned and reused.

SUMMARY OF THE INVENTION

The present invention comprises a top window treatment crown and the method of constructing it which overcomes, to a large degree, the shortcomings and drawbacks of the prior art, as set forth in the foregoing.

The method of constructing the crown comprises forming a face board of rigid foamed plastic material such as, for example, dense expanded polystyrene. Such material is extremely light in weight, as compared to wood or plywood, is water resistant, unaffected by normal temperature swings, odorless, does not attract insects, and, above all, possesses extremely high physical strength and dimensional stability as compared to wood of similar dimensions.

The face board is cut to appropriate size and shape by knife, razor or similar tool. In practice, the component boards of the assembly may be hot-wire cut from large pieces of the foam material. In like manner, a dust board is cut to appropriate size, as are the two side boards. The side boards are cut so that their height is the same as the height of the face board less the thickness of the dust board, while the depth of the side boards are the same as the depth of the dust board.

The leading edge of the dust board is then bonded to the rear surface of the face board, at the top thereof and flush with the top edge by depositing a continuous stream of non-chemical solvent adhesive, such as a water based cement, along the leading edge of the dust board, and the two parts are held in alignment until the adhesive sets sufficient to maintain the junction. For simplicity, the face board is laid face down on a flat surface and the dust board extends upwardly therefrom.

Each side board has two adjacent edges, one of which contacts the underside of the dust board and the other of which contacts the rear face of the face board along the edges of both boards. A continuous line of adhesive, such as a bead of cement is deposited on each of these edges and each side board is pressed into place and held while the cement sets sufficiently to maintain the junctions.

Right angle brackets of a material such as high impact polystyrene are provided for mounting the crown to the wall over the window. These brackets, usually no more than two because of the light weight of the window crown, can be attached to the wall by ordinary nails or screws, or by double sided adhesive tape, inasmuch as molly or toggle bolts are generally not necessary, thereby minimizing damage to the wall. The window crown rests on the brackets and is stabilized by elongated thumb tacks, which pass through holes in the brackets and are thumb or hand pushed into the polystyrene foam of the window crown.

As thus far described, the only tools necessary to assemble and mount the crown are a knife or cutting tool if it is necessary to size the boards, and a hammer or screwdriver for mounting the brackets to the wall. Thus the entire process can be readily performed by one person having a minimum of mechanical aptitude.

Covering the crown with, for example, a decorative fabric, likewise is quite simple and requires only a pair of scissors for trimming the material. The material is laid over the outer faces of the face board, dust board and side boards, wrapped around the bottom edges thereof, and fastened into place on the rear surfaces of the boards by means of trim pins, which are two-pronged pins having small shoulders formed in each prong. The pins are driven into place by thumb pressure and held in place by the shoulders and their natural resiliency.

When the face board is used, the crown produces an effect similar to a cornice. Elimination or removal of the face board produces a crown having an appearance and effect similar to a valance.

The invention and the numerous features and advantages thereof will be readily apparent from the following detailed description, read in conjunction with the following drawings, in which:

FIG. 1 is an exploded, perspective view of the window treatment crown embodying the principles of the present invention;

FIG. 2 is a perspective view of an assembled crown;

FIG. 3 is a sectional elevation view of the window treatment crown having a decorative fabric mounted thereon; and FIG. 3A is a detail of the arrangement of FIG. 3.

DETAILED DESCRIPTION OF THE DRAWINGS

In FIG. 1 there is shown the relationship of the various components of the window treatment crown 11 of the present invention, from which the method of assembling the crown is apparent. Form 11 comprises a face board 12 of a rigid foamed plastic material, such as for example, dense expanded polystyrene. As illustrated in FIG. 1, the crown is intended to fit over a standard thirty-six inch window, and to this end the face board is cut to a length dimension (A) of approximately forty-four inches. The height (B) of the crown is cut to a length of approximately fifteen inches, and the thickness (C) is approximately one inch. This thickness is adequate to ensure an extremely stiff face board 11, with a weight approximately one-tenth to one-twentieth that of a wood board of similar dimensions.

A dust board 13 for attachment to the top edge 17 of board 12 against the inside face 18 thereof is made the same length as face board 12 and is also approximately one inch thick. The depth (D) of board 13 may be made any desired dimension, five inches, for example, representing the usual depth for a dust board of a cornice having the dimensions set forth. The front edge 19 of board 13 has deposited thereon a continuous stream of adhesive or bead of cement, not shown, which, as pointed out heretofore is preferably water based to eliminate any possible reaction between the adhesive and the polystyrene. An example of such an adhesive is manufactured by Franklin International, and is designated "Franklin House, Shop and Craft Glue". Front edge 19 is then pressed firmly against face 18 so that the top surface of board 13 and edge 17 are aligned along their length, and held in place until the adhesive commences to set. This gluing process can be simplified by laying the front surface of board 12 down on a flat surface and bonding board 13 thereto so that it extends vertically upwardly therefrom.

First and second side boards 14 and 16 are sized to have their width (G) the same as the depth (D) of board 13, and to have their height (H) one inch less than height (B) of board 12. That is, the height of boards 14 and 16 is equal to the height of board 12 less the thickness of board 13. After the adhesive between boards 12 and 13 has set enough to maintain the junction therebetween, the edges 21 and 22 of board 14 and the corresponding edges of board 16 have a continuous line of adhesive drawn therealong, and these boards 14 and 16 are mounted in place, as can best be seen in FIG. 2, and held there for enough time to allow the adhesive to set sufficiently to hold the boards 14 and 16 firmly in place.

After the cement has set, the crown, as best seen in FIG. 2, is ready to be mounted. To this end, as seen in FIG. 1, a pair of right angle brackets 23 and 24 of a suitable plastic material such as high impact polystyrene are provided. Each of brackets 23 and 24 has drilled in the depending leg a pair of vertically offset separated nail or screw holes through which nails or screws 28, 28 pass for mounting the bracket to the wall above the window. Inasmuch as crown 11 actually weighs considerably less than, for example, a small framed picture, the anchoring of screws 28, 28 is not necessary, although some form of anchoring may be used.

Crown 11 is attached to brackets 23 and 24 to rest upon the outwardly extending legs thereof by means of elongated tacks 32, 32 which extend through holes 29 and 31 in the bracket, and are pressed into the dust board 13 through the underside thereof. Because of the light weight of the crown, only one tack per bracket is necessary.

When it is desired to cover the crown 11 with, for example, a decorative fabric, it is a simple matter to remove tacks 32, 32 and lift the crown off of the brackets. In FIG. 3 there is shown a cross-section of crown 11 having a layer 33 of fabric thereon. As can be seen, the material is anchored to board 13 at the rear top thereof by means of trim pins 34, and is stretched down over the front face of board 12, under the bottom edge thereof, and up the rear surface, where it is likewise anchored by means of one or more pins 34. As can be seen in FIG. 3A, pins 34 comprise a pair of prongs 36 and 37, joined at one end by a cross piece 38. The prongs 36 and 37 are shaped to have a shoulder 39 near the end joined by piece 38, forming indentation 41 in each prong. Pins 34, which are commercially available, are virtually ideal for use with the arrangement of the present invention, since the foam material grips the pins at the recess 41 when the pin is pushed into place.

If it is desired, a layer of padding, not shown, may underlie fabric 33 and overly boards 12 and 13 to give a more rounded effect, and to relieve the harshness of the square corners.

As pointed out heretofore, the crown piece of the present invention can be used to produce the effect of a cornice or, upon removal of the face plate 12, the effect of a valance.

It can readily be appreciated that the top treatment crown of the invention can be packaged in kit form, with the various parts cut to the proper length, and quickly and easily assembled. Where necessary to shorten the lengths, a kitchen knife, razor blade or Exacto knife would be all that was required.

The foregoing description has illustrated the principles of the invention in the method of assembling a decorative top window treatment crown, and the crown resulting from the application of the method. Numerous changes or variations of these principles may occur to workers in the art without departure from the spirit and scope of the invention.

What is claimed is:

1. A method of making a window top treatment crown assembly comprising the steps of:

positioning a face board of appropriate length and height, the face board having front and rear surfaces and a top surface extending the length thereof, said face board comprising an expanded plastic foam material, positioning a dust board having top and bottom surfaces and a leading edge of said appropriate length, the dust board being made of the same material as the face board, applying a line of adhesive along the leading edge of the dust board, pressing the leading edge of the dust board to the top of the rear surface of the face board adjacent said top surface and holding the two boards in contact with the top surface of the dust board in alignment with the top edge of the face board until the adhesive is partially set, positioning first and second side boards having top and front edges and being made of the same material as the dust board and face board, applying a line of adhesive to the top and front edges of each of the side boards, pressing the top edge of each of the side boards to the bottom surface of the dust board at the ends thereof and pressing the front edge of each of the side boards to the rear surface of the face board at each end thereof, holding the side boards in contact with the dust board and the face board with the outer surface of the side boards flush with the ends of the dust board and the face board until the adhesive is at least partially set, and connecting angled mounting brackets to the bottom surface of the dust board by means of tacks.

2. The method of making a window top treatment crown assembly as claimed in claim 1 and including the preliminary step of cutting the dust boards and face board to proper length.

3. The method of making a window top treatment crown assembly as claimed in claim 2 and including the additional preliminary step of cutting the side boards to have a height less than the height of the face board by the thickness of the dust board.

4. The method of making a window top treatment crown assembly as claimed in claim 1 wherein the adhesive is a water based adhesive.

5. The method of making a window top treatment crown assembly as claimed in claim 1 wherein the angled mounting brackets are of high impact polystyrene, with holes drilled therein to permit passage of the tacks.

6. The method of making a window top treatment form assembly as claimed in claim 1 wherein the material of the face board is expanded polystyrene.

7. A method of making a window top treatment crown assembly comprising the steps of:

positioning a dust board member of appropriate length, said dust board member having top and bottom surfaces and comprising an expanded plastic foam material;

positioning first and second side boards having top edge surfaces and inner and outer surfaces and being made of the same material as said dust board at either end of said dust board;

applying a line of adhesive to the top edge surfaces of each of the side boards;

pressing the top edge of each of the side boards to the bottom surface of the dust board at the ends thereof;

holding the side boards in contact with the dust board with the outer surface of the side boards flush with the ends of the dust board until the adhesive is at least partially set; and connecting mounting members to the bottom surface of the dust board.

8. A window top treatment crown assembly made in accordance with the method of an of the foregoing claims.

* * * * *